US006076865A

United States Patent [19]

Sokurenko et al.

[11] Patent Number: 6,076,865

[45] Date of Patent: Jun. 20, 2000

[54] DRAW LATCH

[75] Inventors: William E. Sokurenko, Glenolden; Eric D. Hyp, Aspers, both of Pa.; Jeffrey L. Antonucci, Worcester, United Kingdom

[73] Assignee: Southco, Inc., Concordville, Pa.

[21] Appl. No.: 09/233,759

[22] Filed: Jan. 20, 1999

Related U.S. Application Data

[60] Provisional application No. 60/072,143, Jan. 22, 1998.

[51] Int. Cl.[7] ..... E05C 5/00

[52] U.S. Cl. ..... 292/113; 292/DIG. 49

[58] Field of Search ..... 292/247, 246, 292/66, 67, 113, 114, 109, DIG. 49, 63

[56] References Cited

U.S. PATENT DOCUMENTS

| | | | |
|---|---|---|---|
| 2,784,994 | 3/1957 | Hopkins | 292/247 |
| 3,026,133 | 3/1962 | Swanson | 292/113 |
| 3,030,137 | 4/1962 | Cheney | 292/113 |
| 3,127,205 | 3/1964 | Griffiths et al. | 292/113 |
| 3,134,617 | 5/1964 | Slonneger | 292/113 X |
| 3,237,978 | 3/1966 | Swanson | 292/247 |
| 3,384,402 | 5/1968 | Swanson | 292/113 |
| 3,526,422 | 9/1970 | Trotter | 292/247 |
| 3,618,995 | 11/1971 | McLean | 292/247 X |
| 3,706,467 | 12/1972 | Martin | 292/113 X |
| 4,181,333 | 1/1980 | Stelma | 292/113 X |
| 4,627,650 | 12/1986 | Hauschulte | 292/113 |
| 4,830,413 | 5/1989 | Bisbing | 292/247 |
| 4,890,869 | 1/1990 | Langkamp, Jr. | 292/113 |
| 5,127,684 | 7/1992 | Klotz et al. | 292/113 |
| 5,131,246 | 7/1992 | Bonzer | 292/113 X |
| 5,271,649 | 12/1993 | Gromotka | 292/113 |
| 5,607,195 | 3/1997 | Antonucci | 292/247 |
| 5,626,373 | 5/1997 | Chambers et al. | 292/113 |
| 5,655,799 | 8/1997 | Takimoto | 292/113 |
| 5,732,987 | 3/1998 | Wright et al. | 292/247 X |

*Primary Examiner*—B. Dayoan
*Assistant Examiner*—Gary Estremsky
*Attorney, Agent, or Firm*—Paul & Paul

[57] ABSTRACT

A draw latch for latching together two closure member having an open and a closed position and having a keeper, a base bracket, a housing, and a clevis, the keeper secured to one of the closure members, the base bracket attached to the other of the closure members, the housing having a first end and a second end, the first end of the housing pivotally and detachably connected to the keeper, the clevis having a first and a second end, the first end of the clevis pivotally secured to the base bracket, and the second end of the clevis pivotally secured to the second end of the housing; and the draw latch having secondary catches to secure the draw latch in the open and/or closed position.

5 Claims, 7 Drawing Sheets

DRAW LATCH

REFERENCE TO RELATED APPLICATION

This application claims the benefit of U.S. Provisional Application No. 60/072,143, filed Jan. 22, 1998.

BACKGROUND OF THE INVENTION

This invention relates to draw latches for latching together two closure members. The latch is referred to as a "draw latch" because it forcibly draws together the two members on which the latch members are mounted. Such members may be components of a cabinet, a case, a housing for a machine, or any type of enclosure. In many cases, the closure members will be co-planar panels. But in other cases, the two closure members will be angularly disposed, such as at an angle to each other, for example, at right angles, or when used to close a "pop-open" style window in an automobile.

Draw latches are essentially toggle latches having three links and three pivot points. One of the pivot points is disengageable so that the latch may be unlatched to separate the closure members.

The present invention relates particularly to a draw latch of the toggle type. A unique aspect of this invention is special features that allow the latch to be held firmly in place by secondary catching features in a fully open position and/or a fully closed position.

Numerous draw latches are in the prior art, including U.S. Pat. No. 4,540,206 to Frame et al., the complete specification of which is incorporated by reference herein.

SUMMARY OF THE INVENTION

The draw latch of the present invention is for latching together two closure members. The draw latch has an open and a closed position and has a keeper secured to one of the closure members, a bracket attached to the other of the closure members, and a housing having a first end and a second end with the first end of the housing pivotally and detachably connected to the keeper, and a clevis having a first and a second end. The first end of the clevis is pivotally secured to the bracket, and the second end of the clevis is pivotally secured to the second end of the housing. The housing has a secondary catch means to secure the draw latch in the open position. In addition to or instead of the secondary catch means to hold the latch in the open position, the housing may have a second secondary catch means to secure the draw latch in the closed position.

It is therefore an object of the present invention to provide an improved draw latch that has a secondary catch means to secure the latch in either an open and/or a closed position.

It is a further object of the present invention to provide an improved draw latch that has a secondary catch means to secure the latch in either an open and/or a closed position, where the secondary catch means is a detent in the housing.

Other objects and advantages of the present invention will become apparent from the following description taken in conjunction with the accompanying drawings.

BRIEF DESCRIPTION OF THE PREFERRED EMBODIMENT DRAW LATCH

DETAILED DESCRIPTION OF THE PREFERRED EMBODIMENT

Figure 1:
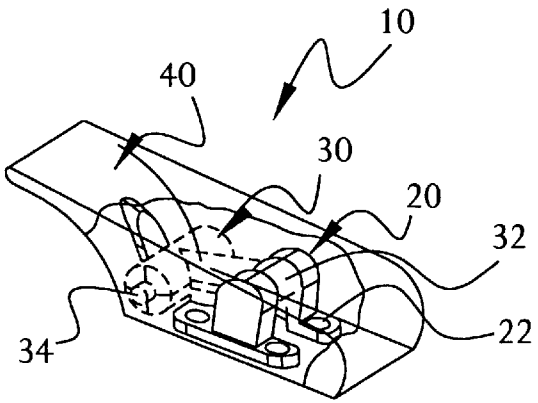
FIG. 1 is a perspective, partially cutaway view of the draw latch of a preferred embodiment of the present invention, with the latch in the closed position.
Figure 2:
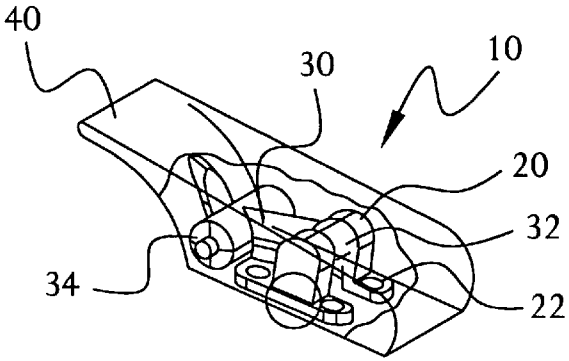
FIG. 2 is a perspective, partially cutaway view of the draw latch of FIG. 1, with the latch in the closed position.
Figure 3:
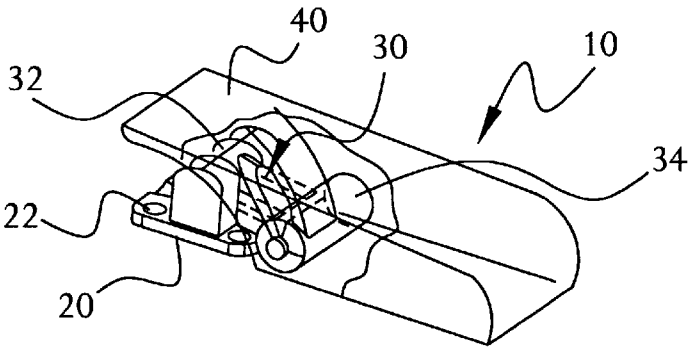
FIG. 3 is a perspective, partially cutaway view of the draw latch of FIG. 1, with the latch in the open position.
Figure 4:
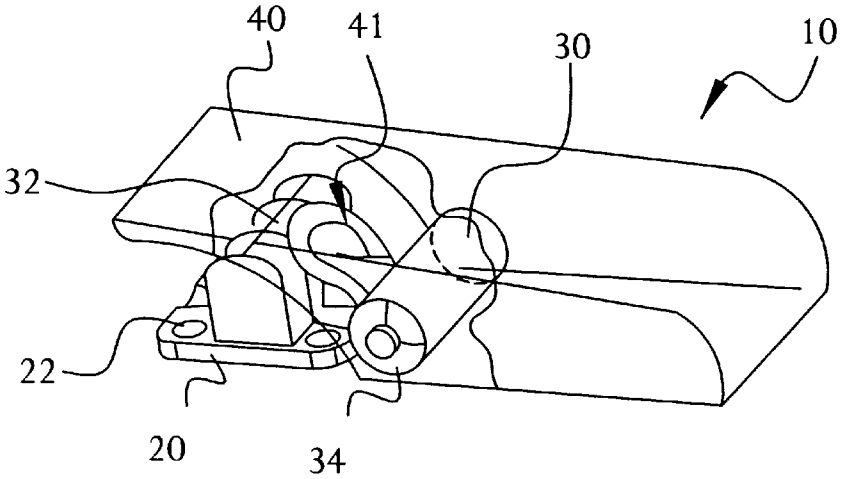
FIG. 4 is a perspective, partially cutaway view of the draw latch of FIG. 1, with the latch in the open position.
Figure 5:
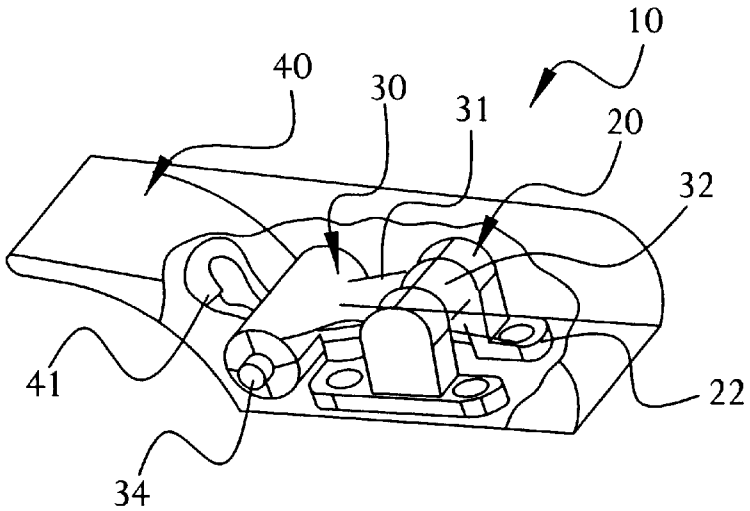
FIG. 5 is a perspective partially cutaway view of the draw latch of FIG. 1, with the latch in the closed position.
Figure 6:
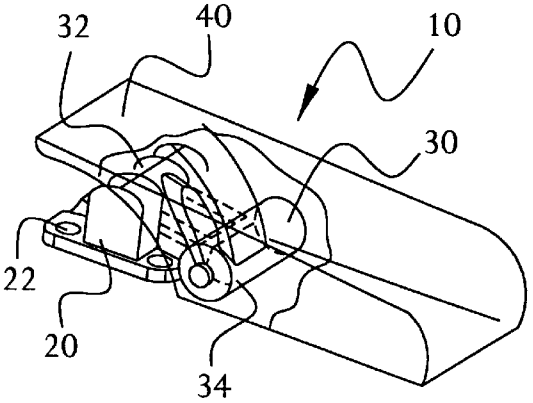
FIG. 6 is a perspective, partially cutaway view of the draw latch of FIG. 1, with the latch in the open position.
Figure 7:
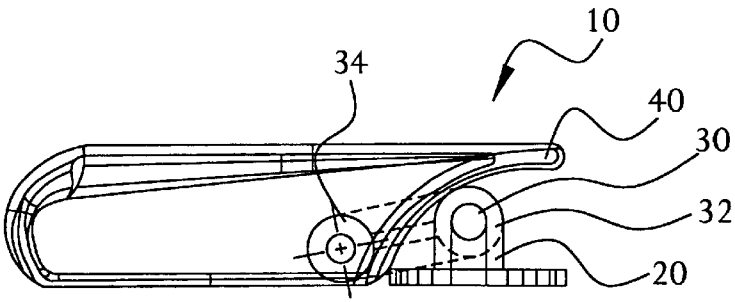
FIG. 7 is a side elevation view of the draw latch of FIG. 1, with the latch in the open position.
Figure 8:
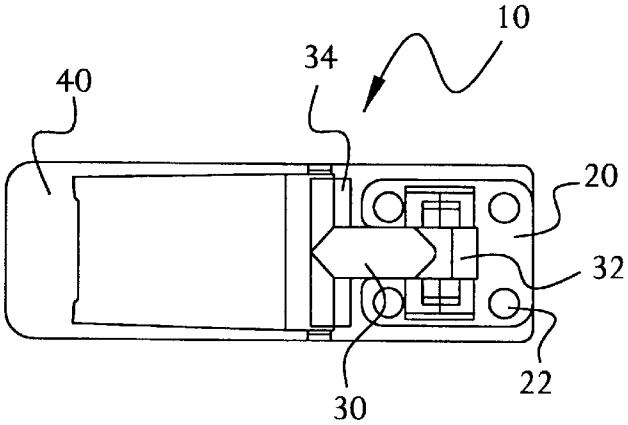
FIG. 8 is a bottom view of the draw latch of FIG. 1, with the latch in the open position.
Figure 9:
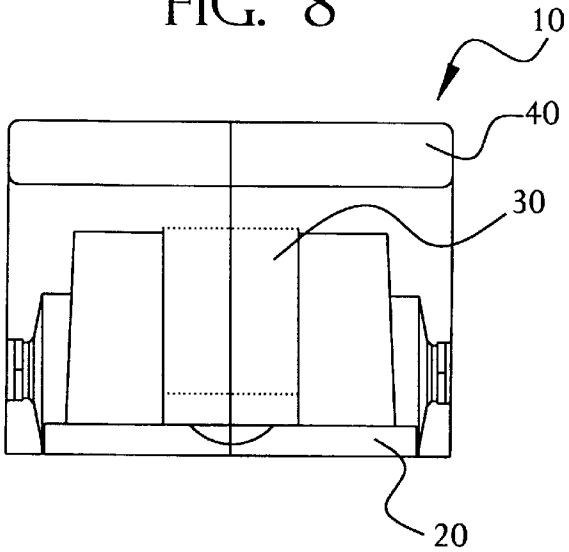
FIG. 9 is a rear elevation view of the draw latch of FIG. 1, with the latch in the open position.

Referring now in detail to the drawings wherein like reference numbers indicate like elements throughout the several views, there is shown in FIGS. 1 through 21 a draw latch 10 in a open or closed position in accordance with one preferred embodiment of the present invention. The illustrative device is shown generally comprising a base bracket 20, a clevis 30, and a housing 40. The keeper 50 is shown for example in FIG. 22 (also clearly depicted as item 21 in U.S. Pat. No. 4,540,206, incorporated herein by reference). The keeper 50 is attached to one closure member 60 as is known in the art, for example, as a keeper for a flip-out style automobile window. Base bracket 20 is secured to another closure member 70, for example, by rivets 23 through holes 22. A first end 32 of clevis 30 is pivotally attached to base bracket 20 such that it is free to swing in an arc of, for example, about 180 degrees. The second end 34 of clevis 30 is pivotally attached to housing 40 in a manner known in the art, as depicted in U.S. Pat. No. 4,540,206.

All of the component parts of the draw latch 10 of the present invention are preferably molded of engineering plastic with the resilience necessary for assembly and use of the components.

Figure 22:
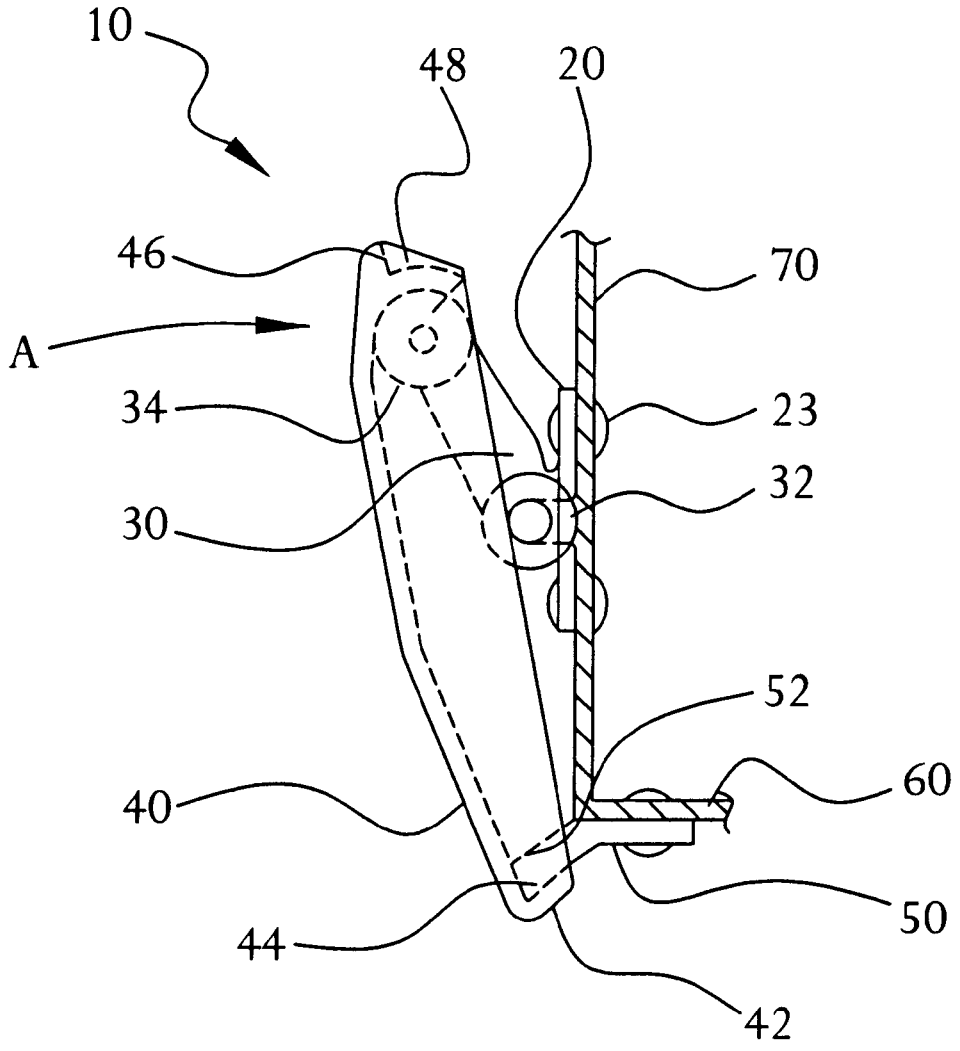
FIG. 22 is a side view of the latch, depicted as mounted on a closure member, being moved in the direction of the arrow toward a fully latched position to draw together and to latch two closure members which are at right angles to one another.

As seen in FIG. 22, the draw latch 10 is shown about to be moved, for example, by manually applying a light force to the end of the housing 40 in the direction of the arrow A toward a fully latched position. The tip of the hooked nose portion 42 at the lower end of the housing 40 is in detachable engagement with the keeper 50 and the inner radius 44 of the hook portion 42 is about to engage the corresponding outer radius of lip 52 of keeper 50.

When the latch 10 is moved from a position which is on the open side of the "on-center" position to the "over-center" fully latched position, the second end 34 of the clevis 30 bears against the inner radius of the upper end of the housing 40. Thus, in the fully latched position, the pivoting joints are positioned in an over center arrangement characteristic of toggle mechanisms.

To unlatch the latch 10, an outward force is applied manually to the upper end 46 of the housing 40, as by placing the fingers under the flange 48.

As indicated, important new features of the present invention are the features which hold the latch in an open position and/or a closed position. As can be seen in particular in FIG. 4 where the draw latch of the present invention is held in the open position, it can be seen that an internal surface of the housing 40 has a keyhole shaped slot 41. This slot acts as a detent such that the main longitudinal shaft of the clevis 30 snaps into place in the keyhole slot 41 to retain the housing 40 in an open position.

Figure 18:
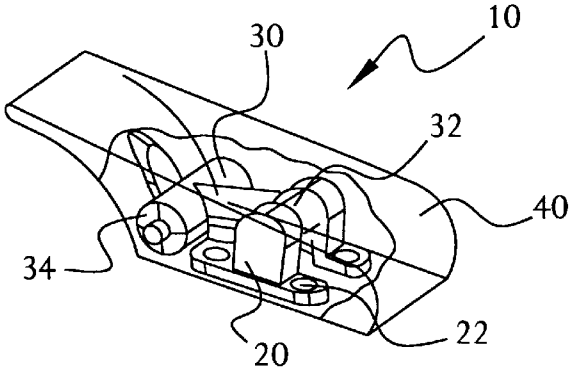
FIG. 18 is a perspective partially cutaway view of the draw latch of FIG. 1, with the latch in the closed position.
Figure 21:
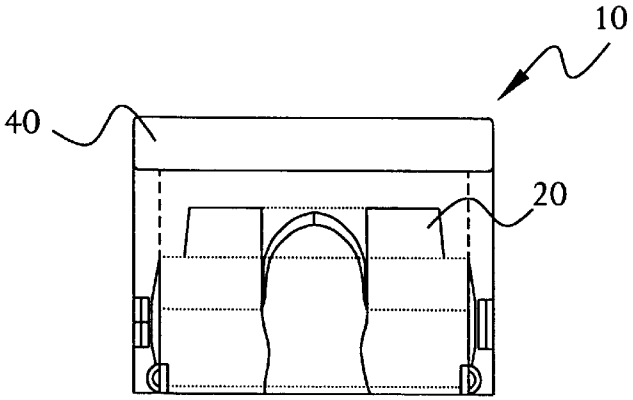
FIG. 21 is a rear elevation view of the draw latch of FIG. 1, with the latch in the closed position.

Additionally, and/or alternatively, another feature adds additional security to hold the latch in the closed position, or acts to hold the latch in a closed position even if a second closure member to which a keeper is attached is not in position. As seen in FIG. 18 and 21 where the latch is in the closed position (and also in FIGS. 10 and 12 where the latch is in the open position), outwardly protruding detent surface 25 on the base bracket 20 mates with a groove 45 extending along the inner surface of the housing 40 such that when the handle 40 is in a fully closed position, whether or not the handle 40 has engaged a keeper, the handle snaps into position and is held in place by the mating detent surface 25 and groove 45.

It will be recognized by those skilled in the art that changes may be made in the above described embodiment of the invention without departing from the broad inventive concepts thereof it is understood, therefore, that this invention is not limited to the particular embodiment disclosed, but is intended to cover all modifications which are within the scope and spirit of the invention as defined by the appended claims.

What is claimed is:

1. A draw latch for latching together two closure members, said draw latch having an open and a closed position, said draw latch comprising:

a. a keeper for securing to one of the closure members;

b. a base bracket for attaching to the other of the closure members;

c. a housing having a first end and a second end, the first end of the housing pivotally and detachably connected to the keeper;

d. a clevis having a first and a second end, the first end of the clevis pivotally secured to the base bracket, and the second end of the clevis pivotally secured to the second end of the housing; and e. said housing having a vertical slot having a narrowed portion matable to said clevis, said acting as a detent such that said clevis snaps into place in said slot to retain said draw latch in its open position.

2. A draw latch for latching together two closure members, said draw latch having an open and a closed position, said draw latch comprising:

a. a keeper for securing to one of the closure members;

b. a base bracket for attaching to the other of the closure members;

c. a housing having a first end and a second end, the first end of the housing pivotally and detachably connected to the keeper;

d. a clevis having a first and a second end, the first end of the clevis pivotally secured to the base bracket, and the second end of the clevis pivotally secured to the second end of the housing; and e. said housing having a secondary catch means to secure the draw latch in the open position, said secondary catch means being a vertical slot in the housing matable to the clevis which allows the clevis to snap into place into a detent when the draw latch is in the open position, said detent being keyhole shaped.

3. A draw latch for latching together two closure members, said draw latch having an open and a closed position, said draw latch comprising:

a. a keeper for securing to one of the closure members;

b. a base bracket for attaching to the other of the closure members;

c. a housing having a first end and a second end, the first end of the housing pivotally and detachably connected to the keeper;

d. a clevis having a first and a second end, the first end of the clevis pivotally secured to the base bracket, and the second end of the clevis pivotally secured to the second end of the housing; and e. said housing having a first and a second secondary catch means, said first secondary catch means to secure the draw latch in the open position, said second secondary catch means to secure the draw latch in the closed position, said first secondary catch means being a vertical slot matable to said clevis, said slot acting as a detent such that said clevis snaps into place in said slot to retain said draw latch in its open position.

4.The draw latch of claim 3, wherein the detent is keyhole shaped.

5. The draw latch of claim 3, wherein the second secondary catch means is an outwardly protruding detent surface on the base bracket and a mating groove in the housing, extending along the inner surface of the housing, whereby, when the draw latch is in an open position, it is securely held in position.

* * * * *

UNITED STATES PATENT AND TRADEMARK OFFICE

CERTIFICATE OF CORRECTION

PATENT NO. : 6,076,865
DATED : June 20, 2000
INVENTOR(S) : William E. Sokurenko, Eric D. Hyp, and Jeffrey L. Antonucci It is certified that error appears in the above-identified patent and that said Letters Patent is hereby corrected as shown below:

Column 3,
Line 1 (column 1, lines 61-62), should be corrected as:
-- BRIEF DESCRIPTION OF THE PREFERRED EMBODIMENT --

Figure 10:
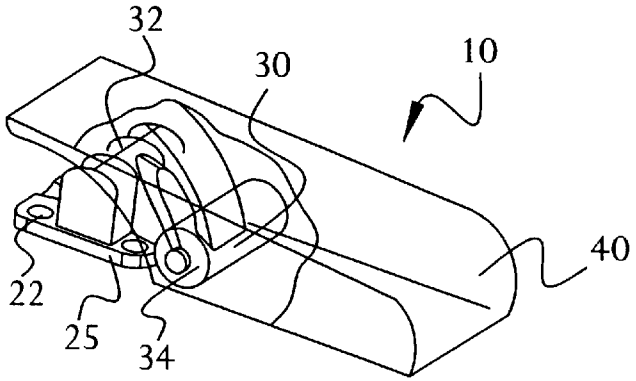
FIG. 10 is a perspective, partially cutaway view of the draw latch of FIG. 1, with the latch in th en position.
Figure 11:
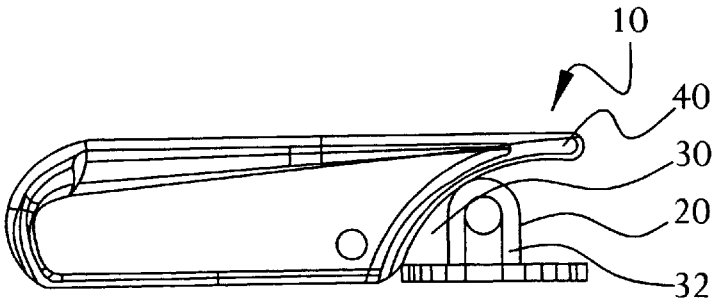
FIG. 11 is a side elevation view of the draw latch of FIG. 1, with the latch in the open position.
Figure 13:
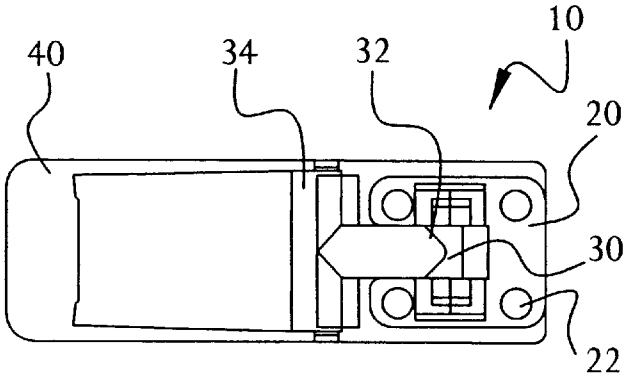
FIG. 13 is a bottom view of the draw latch of FIG. 1, with the latch in the open position.
Figure 12:
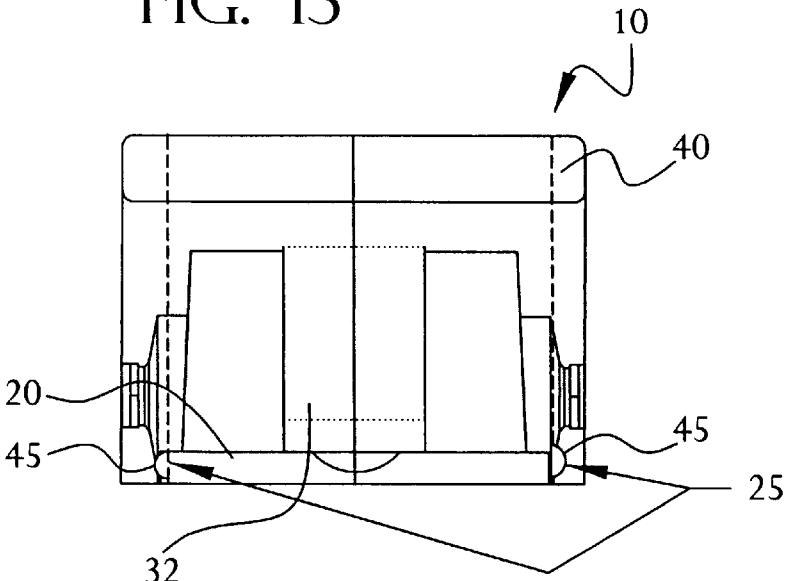
FIG. 12 is a rear elevation view of the draw latch of FIG. 1, with the latch in the open position.
Figure 14:
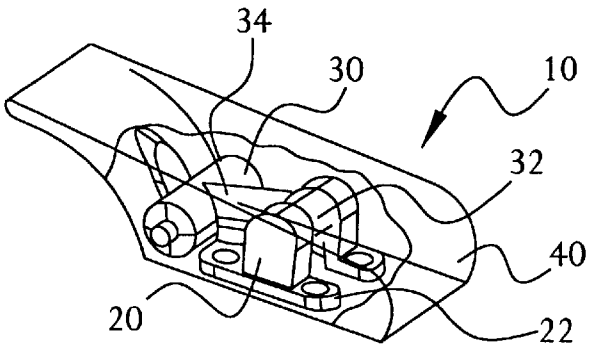
FIG. 14 is a perspective, partially cutaway view of the draw latch of FIG. 1, with the latch in the closed position.
Figure 15:
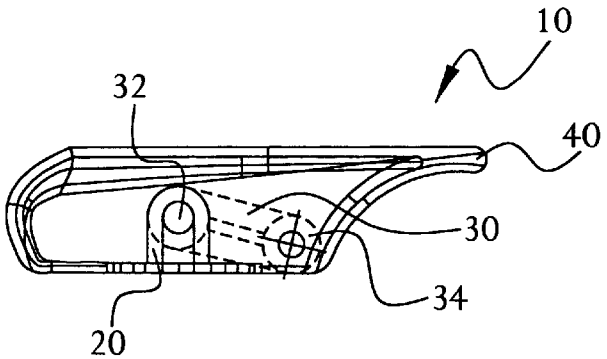
FIG. 15 is a side elevation view of the draw latch of FIG. 1, with the latch in the closed position.
Figure 16:
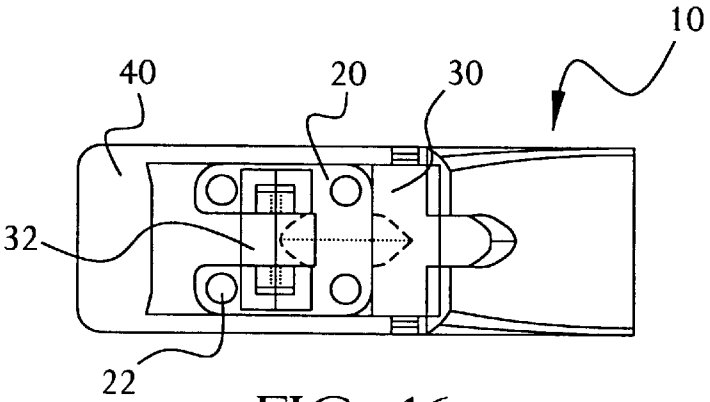
FIG. 16 is a bottom view of the draw latch of FIG. 1, with the latch in the closed position.
Figure 17:
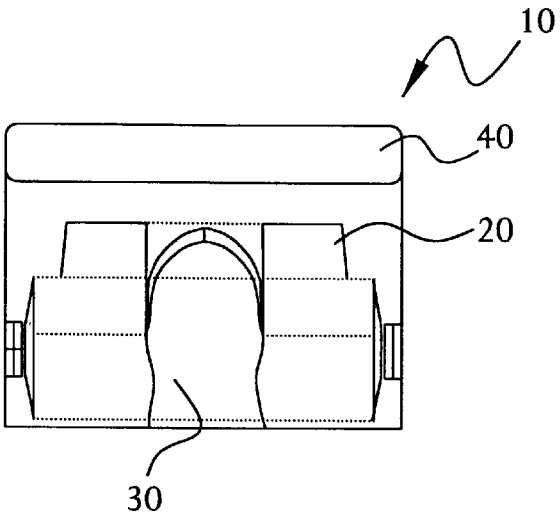
FIG. 17 is a rear elevation view of the draw latch of FIG. 1, with the latch in the closed position.

Column 3,
Lines 20 –21 (column 2, lines 16-17), should be corrected as:
-- FIG. 10 is a perspective, partially cutaway view of the draw latch of FIG. 1, with the latch in the open position.--

Figure 19:
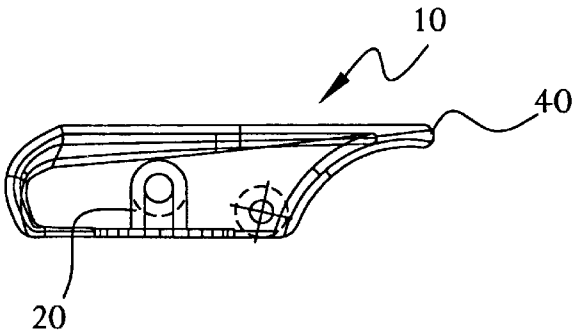
FIG. 19 is a side elevation view of the draw latch of FIG. 1, with the latch in the closed position.
Figure 20:
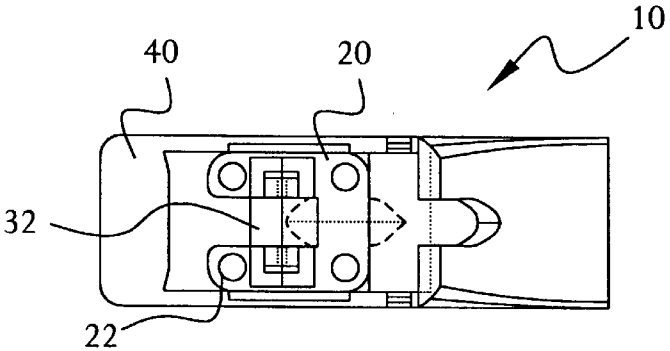
FIG. 20 is a bottom view of the draw latch of FIG. 1, with the latch in the closed position.

Column 4,
Lines 15-18 (column 2, lines 36-39), should be corrected as:
-- FIG. 19 is a side elevation view of the draw latch of FIG. 1, with the latch in the closed position.
FIG. 20 is a bottom view of the draw latch of FIG. 1, with the latch in the closed position. --

Column 6,
Line 23 through page 7, line 4 (column 3, lines 46-53), should be corrected as:
-- It will be recognized by those skilled in the art that changes may be made in the above described embodiment of the invention without departing from the broad inventive concepts thereof. It is understood, therefore, that this invention is not limited to the particular embodiment disclosed, but is intended to cover all modifications which are within the scope and spirit of the invention as defined by the appended claims. --

UNITED STATES PATENT AND TRADEMARK OFFICE

CERTIFICATE OF CORRECTION

PATENT NO. : 6,076,865
DATED : June 20, 2000
INVENTOR(S) : William E. Sokurenko, Eric D. Hyp, and Jeffrey L. Antonucci It is certified that error appears in the above-identified patent and that said Letters Patent is hereby corrected as shown below:

Claim 1 (column 3, line 55 through column 4, line 9), should correctly claim:

-- 1. A draw latch for latching together two closure members, said draw latch having an open and a closed position, said draw latch comprising:

a. a keeper for securing to one of the closure members;

b. a base bracket for attaching to the other of the closure members;

c. a housing having a first end and a second end, the first end of the housing pivotally and detachably connected to the keeper;

d. a clevis having a first and a second end, the first end of the clevis pivotally secured to the base bracket, and the second end of the clevis pivotally secured to the second end of the housing; and e. said housing having a vertical slot having a narrowed portion matable to said clevis, said slot acting as a detent such that said clevis snaps into place in said narrowed portion to retain said draw latch in its open position. --

Signed and Sealed this

Second Day of October, 2001

*Attest:*

Nicholas P. Godici

NICHOLAS P. GODICI
*Acting Director of the United States Patent and Trademark Office*

*Attesting Officer*